US012188741B2

(12) United States Patent
Bednar et al.

(10) Patent No.: US 12,188,741 B2
(45) Date of Patent: Jan. 7, 2025

(54) CROSSBOW WITH TRAVELING TRIGGER AND CONVENTIONAL BOW

(71) Applicant: Hunter's Manufacturing Company, Inc., Suffield, OH (US)

(72) Inventors: Phillip Bednar, Copley, OH (US); Michael Shaffer, Hartville, OH (US)

(73) Assignee: Hunter's Manufacturing Company, Inc.

( * ) Notice: Subject to any disclaimer, the term of this patent is extended or adjusted under 35 U.S.C. 154(b) by 0 days.

(21) Appl. No.: 18/173,324

(22) Filed: Feb. 23, 2023

(65) Prior Publication Data

US 2023/0288168 A1 Sep. 14, 2023

Related U.S. Application Data

(60) Provisional application No. 63/268,392, filed on Feb. 23, 2022.

(51) Int. Cl.
*F41B 5/12* (2006.01)
*F41B 5/00* (2006.01)
*F41B 5/14* (2006.01)

(52) U.S. Cl.
CPC ..... *F41B 5/1469* (2013.01); *F41B 5/0052* (2013.01); *F41B 5/123* (2013.01)

(58) Field of Classification Search
CPC ..... F41B 5/12; F41B 5/123
See application file for complete search history.

(56) References Cited

U.S. PATENT DOCUMENTS

| | | | | |
|---|---|---|---|---|
| 6,095,128 | A | 8/2000 | Bednar | |
| 8,499,753 | B2 * | 8/2013 | Bednar | F41B 5/12 124/25 |
| 9,200,863 | B2 | 12/2015 | Bednar | |
| 9,383,159 | B2 | 7/2016 | Pulkrabek et al. | |
| 9,404,706 | B2 * | 8/2016 | Khoshnood | F41B 5/123 |
| 9,958,232 | B1 * | 5/2018 | Egerdee | F41B 5/1403 |
| 10,107,584 | B1 | 10/2018 | Anderson | |
| 10,145,641 | B2 | 12/2018 | Hout | |
| 10,260,835 | B2 | 4/2019 | Pulkrabek et al. | |
| 10,690,436 | B1 * | 6/2020 | Kempf | F41B 5/1469 |
| 10,739,104 | B1 | 8/2020 | Smith et al. | |
| 11,131,524 | B1 * | 9/2021 | Kempf | F41B 5/123 |
| 11,156,430 | B2 * | 10/2021 | Smith | F41B 5/123 |
| 11,221,191 | B2 | 1/2022 | Bednar et al. | |
| 11,874,085 | B2 * | 1/2024 | Barnett | F41B 5/1469 |

* cited by examiner

*Primary Examiner* — John A Ricci
(74) *Attorney, Agent, or Firm* — Emerson, Thomson & Bennett, LLC

(57) ABSTRACT

A crossbow may include a main beam and a bow mechanism having a pair of outwardly extending bow limbs, a pair of bowstring wheels, a bowstring and at least one power cord that extends between the bow limbs. The crossbow may also include a traveling trigger mechanism and a drawing mechanism. The traveling trigger mechanism may hold the bowstring in the un-cocked condition. The drawing mechanism may then be operated to move the traveling trigger mechanism and thus the bow string from the un-cocked condition to a cocked condition.

20 Claims, 11 Drawing Sheets

CROSSBOW WITH TRAVELING TRIGGER AND CONVENTIONAL BOW

This application claims priority to U.S. Provisional Patent Application No. 63/268,392, titled Crossbow With Traveling Trigger And Conventional Bow, filed Feb. 23, 2022, which is incorporated herein by reference.

I. BACKGROUND

A. Field of the Invention

This invention generally relates to apparatuses and methods regarding crossbows; and more specifically to apparatuses and methods regarding crossbows having traveling trigger mechanisms.

B. Description of Related Art

Crossbows have been used for many years as a weapon for hunting and fishing, and for target shooting. In general, a crossbow includes a main beam and a bow mechanism supported to the main beam. The bow mechanism may have a pair of bow limbs and a bowstring engaged to the bow limbs. Often the bow mechanism has wheels on the bow limbs that receive the bowstring, but this is not always the case. The bowstring may be movable from an un-cocked position (sometimes referred to as an undrawn position) to a cocked position (sometimes referred to as a drawn position). This movement of the bowstring is typically referred to as cocking the crossbow, cocking the bow mechanism, and/or cocking the bowstring. Many times, the bow mechanism also includes one or more power cords to assist in balancing the forces encountered when cocking and firing the crossbow. Often the power cords extend from one limb to the opposite limb. A bow including one or more such power cords can be considered a conventional bow.

A trigger mechanism may be fixedly supported to the main beam and operable to hold the bowstring and to release the bowstring to fire the crossbow to shoot an arrow or bolt. In other applications, the trigger mechanism is not fixed to the main beam but instead moves along the main beam with the bowstring when the bowstring is moved from the un-cocked position to the cocked position. In this case the trigger mechanism can be considered a traveling trigger mechanism. A drawing mechanism may be used to move the traveling trigger mechanism.

While crossbows with traveling trigger mechanisms are known, traveling trigger mechanisms used on crossbows with conventional bows are unknown. However, such a crossbow would be beneficial to many users of crossbows and thus an important improvement in the field of crossbows.

II. SUMMARY

According some embodiment of this invention, a crossbow may include a main beam: 1) extending longitudinally; 2) defining a longitudinal axis; and 3) having an arrow receiving surface for receiving an associated arrow; a bow mechanism including: 1) first and second outwardly extending bow limbs extending transversely from opposite lateral sides of the main beam; 2) first and second bowstring wheels supported to the first and second bow limbs, respectively; 3) a bowstring operatively engaged to the first and second bowstring wheels and movable between: (a) an un-cocked position; and (b) a cocked position; and 4) a first power cord having: (a) a first end operatively engaged with at least one of the first bow limb and the first bowstring wheel; (b) a second end, opposite the first end, operatively engaged with at least one of the second bow limb and the second bowstring wheel; and (c) a mid-section between the first and second ends that extends across the longitudinal axis from opposite lateral sides of the main beam; a traveling trigger mechanism including: 1) a trigger housing; and 2) a string catch supported to the trigger housing and selectively movable between: (a) a first string catch position that does not hold the bowstring; and (b) a second string catch position that holds the bowstring; and a drawing mechanism including: 1) a drawing housing supported to the main beam; 2) a spool that is selectively rotatable with respect to the drawing housing; and 3) a tensile member having: (a) a first end operatively engaged with the spool; and (b) a second end operatively engaged with the trigger housing. Wherein: 1) when the bowstring is in the un-cocked position and the string catch is in the second string catch position that holds the bowstring: the drawing mechanism is selectively operable to move the traveling trigger mechanism longitudinally along the main beam to move the bowstring from: (a) the un-cocked position; to (b) the cocked position; and 2) when the string catch is in the second string catch position that holds the bowstring and the bowstring is in the cocked position: the string catch is selectively movable into the first string catch position that does not hold the bowstring and fires the crossbow.

According to some embodiments of this invention, a crossbow method may include the steps of: A) providing a crossbow having: 1) a main beam: (a) extending longitudinally; (b) defining a longitudinal axis; and (c) having an arrow receiving surface for receiving an associated arrow; 2) a bow mechanism including: (a) first and second outwardly extending bow limbs extending transversely from opposite lateral sides of the main beam; (b) first and second bowstring wheels supported to the first and second bow limbs, respectively; (c) a bowstring operatively engaged to the first and second bowstring wheels; and (d) a first power cord having: (i) a first end operatively engaged with at least one of the first bow limb and the first bowstring wheel; (ii) a second end, opposite the first end, operatively engaged with at least one of the second bow limb and the second bowstring wheel; and (iii) a mid-section between the first and second ends that extends across the longitudinal axis from opposite lateral sides of the main beam; B) providing a traveling trigger mechanism including: 1) a trigger housing; and 2) a string catch supported to the trigger housing; C) providing a drawing mechanism including: 1) a drawing housing supported to the main beam; 2) a spool that is selectively rotatable with respect to the drawing housing; and 3) a tensile member having: (a) a first end operatively engaged with the spool; and (b) a second end operatively engaged with the trigger housing; D) providing the bowstring to be movable between: 1) an un-cocked position; and 2) a cocked position; E) providing the string catch to be selectively movable between: 1) a first string catch position that does not hold the bowstring; and 2) a second string catch position that holds the bowstring; F) when the bowstring is in the un-cocked position and the string catch is in the second string catch position that holds the bowstring, providing the drawing mechanism to be selectively operable to move the traveling trigger mechanism longitudinally along the main beam to move the bowstring from: 1) the un-cocked position; to 2) the cocked position; and G) when the string catch is in the second string catch position that holds the bowstring and the bowstring is in the cocked position, providing the string catch to be selectively movable into the first string catch position that does not hold the bowstring and fires the crossbow.

According to some embodiments of this invention, a crossbow may include a main beam: 1) extending longitudinally; 2) defining a longitudinal axis; 3) having an arrow receiving surface for receiving an associated arrow; and 4) having a power cord receiving opening; a cable receiving device that is positioned at least partially within the power cord receiving opening and is selectively movable with respect to the main beam; a bow mechanism including: 1) first and second outwardly extending bow limbs extending transversely from opposite lateral sides of the main beam; 2) first and second bowstring wheels supported to the first and second bow limbs, respectively; 3) a bowstring operatively engaged to the first and second bowstring wheels and movable between: (a) an un-cocked position; and (b) a cocked position; 4) a first power cord having: (a) a first end operatively engaged with at least one of the first bow limb and the first bowstring wheel; (b) a second end, opposite the first end, operatively engaged with at least one of the second bow limb and the second bowstring wheel; and (c) a mid-section between the first and second ends that: extends across the longitudinal axis from opposite lateral sides of the main beam; is received in the cable receiving device; and extends through the power cord receiving opening; and 5) a second power cord distinct from the first power cord and having: (a) a first end operatively engaged with the at least one of the first bow limb and the first bowstring wheel; (b) a second end, opposite the first end, operatively engaged with the at least one of the second bow limb and the second bowstring wheel; and (c) a mid-section between the first and second ends that: extends across the longitudinal axis from opposite lateral sides of the main beam; is received in the cable receiving device; and extends through the power cord receiving opening; a traveling trigger mechanism including: 1) a trigger housing; and 2) a string catch supported to the trigger housing and selectively movable between: (a) a first string catch position that does not hold the bowstring; and (b) a second string catch position that holds the bowstring; and a drawing mechanism including: 1) a drawing housing supported to the main beam; 2) a spool that is selectively rotatable with respect to the drawing housing; and 3) a tensile member having: (a) a first end operatively engaged with the spool; and (b) a second end operatively engaged with the trigger housing. Wherein: 1) when the bowstring is in the un-cocked position and the string catch is in the second string catch position that holds the bowstring: the drawing mechanism is selectively operable to move the traveling trigger mechanism longitudinally along the main beam to move the bowstring from: (a) the un-cocked position; to (b) the cocked position; and 2) when the string catch is in the second string catch position that holds the bowstring and the bowstring is in the cocked position: the string catch is selectively movable into the first string catch position that does not hold the bowstring and fires the crossbow.

Benefits and advantages of this invention will become apparent to those skilled in the art to which it pertains upon reading and understanding of the following detailed specification.

III. BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

IV. DETAILED DESCRIPTION

Figure 1:
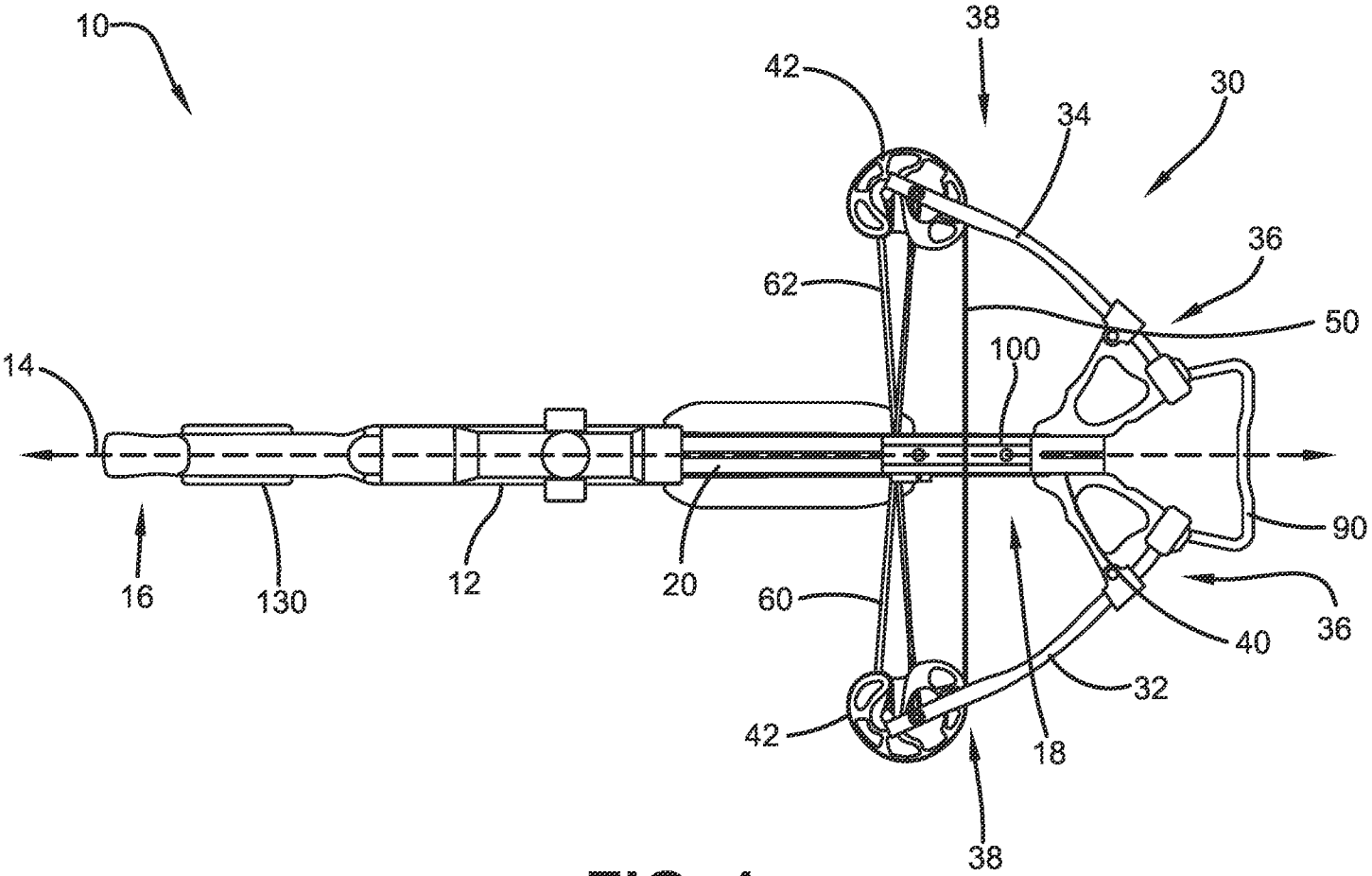
FIG. 1 is a top view of a crossbow according to some embodiments of this invention.
Figure 2:
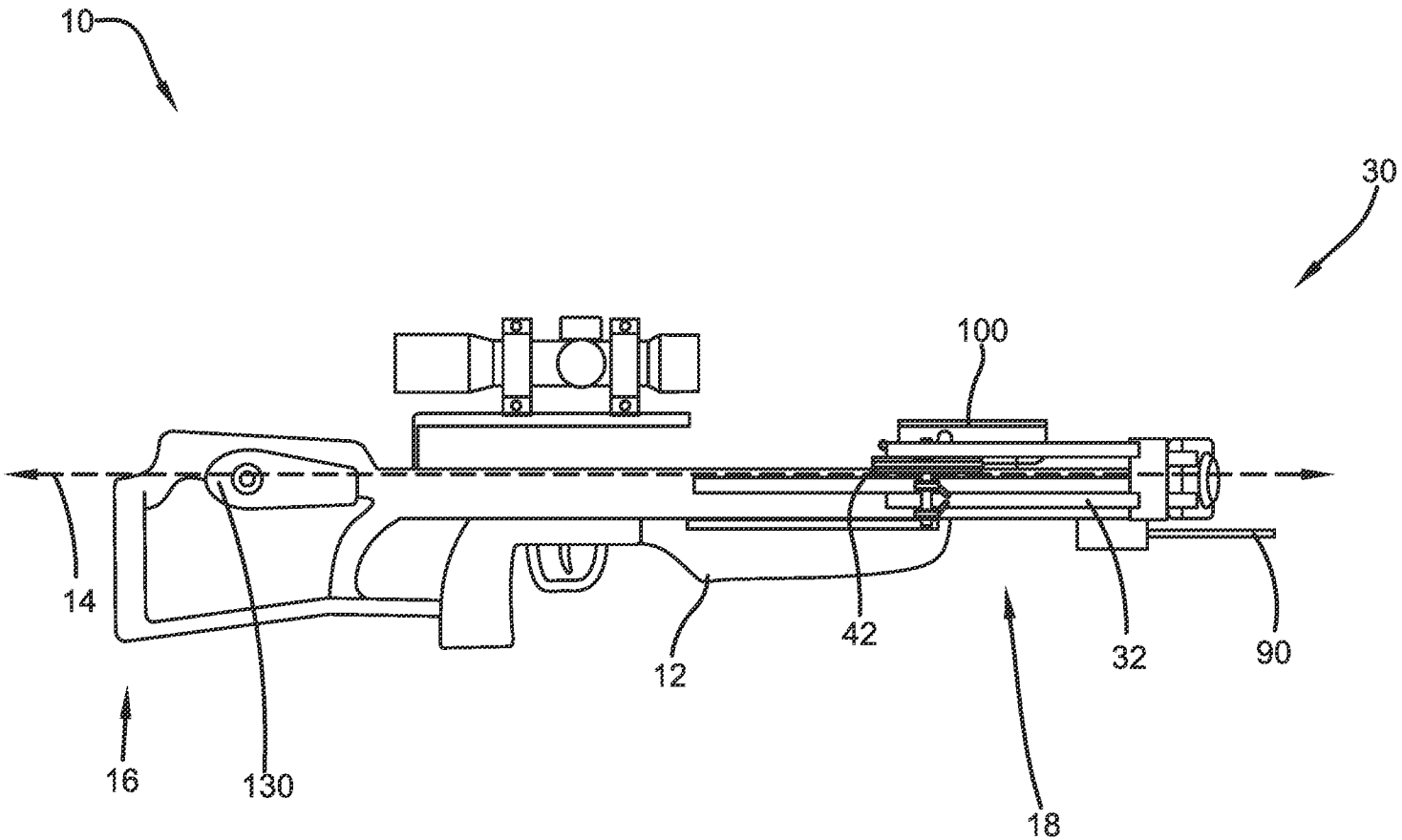
FIG. 2 is a side view of the crossbow shown in FIG. 1 showing the bowstring in an un-cocked position according to some embodiments of this invention.
Figure 3:
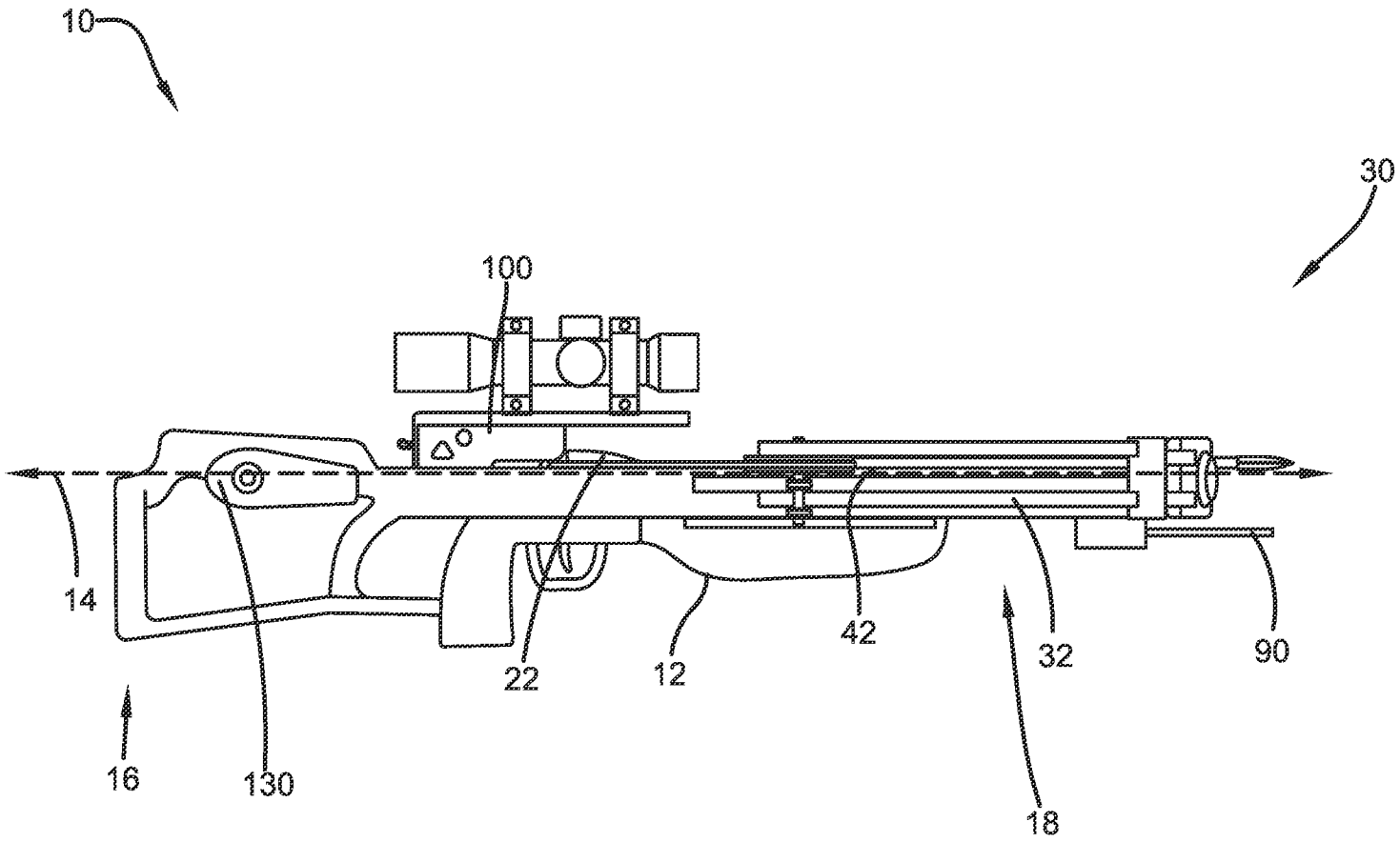
FIG. 3 is a side view of a crossbow according to some embodiments of this invention, showing the bowstring in a cocked position.

Referring now to the drawings wherein the showings are for purposes of illustrating embodiments of the invention only and not for purposes of limiting the same, and wherein like reference numerals are understood to refer to like components, FIGS. 1-4 show a crossbow 10 according to some embodiments of the present subject matter. Crossbow 10 may include a main beam 12 extending longitudinally and defining a longitudinal axis 14, a proximal end 16 and a distal end 18. The main beam 12 may have an arrow receiving surface 20 that receives and supports an arrow 22 to be fired by the crossbow 10.

With reference now to FIGS. 1-6, crossbow 10 may include a bow mechanism 30 including first and second outwardly extending bow limbs 32, 34 extending transversely from opposite lateral sides of the main beam 12, as shown. Each bow limb 32, 34 may have a first end 36 supported to the main beam 12 and second end 38 opposite the first end 36. In some embodiments, the first ends 36, 36 may be supported directly to the main beam 12. For the embodiments shown, the first ends 36, 36 are supported to the main beam 12 via a riser 40. For the embodiments shown, the bow mechanism 30 is supported to the distal end 18 of the main beam 12. The bow limbs may be of any type chosen with the sound judgment of a person of skill in the art. For the embodiments shown, the bow limbs 32, 34 are split limbs. For the embodiments shown, the second ends 38, 38 extend proximally with respect to the first ends 36, 36. The bow mechanism 30 may include a bowstring wheel 42 supported to each of the bow limbs 32, 34. For the embodiments shown, the bowstring wheels 42, 42 are cams supported to the second ends 38, 38 of the bow limbs 32, 34. The cams 42, 42 may be pivotal about pivot pins 44, 44 that are supported to the bow limbs 32, 34, respectively.

With continuing reference to FIGS. 1-6, bow mechanism 30 may include a bowstring 50 having one end 52 operatively engaged to one of bowstring wheels 42, a second end 54, opposite the end 52, operatively engaged to the other bowstring wheel 42 and a mid-section 56 between the ends 52, 54. For the embodiments shown, the bowstring ends 52, 54 are received in bowstring reception surfaces 58, 58 formed on the cams 42, 42. For the embodiments shown, the bowstring reception surfaces 58, 58 include groves formed on the circumference of the cams 42, 42. The bowstring 50 may be movable between an un-cocked position (shown in FIGS. 1, 2 and 4) and a cocked position (shown in FIG. 3). Bow mechanism 30 may include at least one power cord. For the embodiments shown, two power cords 60, 62 may be used. In some embodiments, shown, the power cords 60, 62 are separate and distinct. Each power cord 60, 62 may have first ends 64, 66, respectively, second ends 68, 70, respectively, opposite the first ends 64, 66 and mid-sections 72, 74, respectively, between the ends. For each power cord 60, 62, the first ends 64, 66 are operatively engaged with at least one of the first bow limb 32 and the bowstring wheel 42 on the first bow limb 32 and the second ends 68, 70 are operatively engaged with at least one of the second bow limb 34 and the bowstring wheel 42 on the second bow limb 34, as shown. For the embodiments shown, the first end 64 of power cord 60 is received on a power cord reception surface 80 of the cam 42 on the first bow limb 32 and the second end 68 of power cord 60 is received on the pivot pin 44 of the cam 42 on the second bow limb 34. The first end 66 of power cord 62 is received on the pivot pin 44 of the cam 42 on the first bow limb 32 and the second end 70 of power cord 62 is received on the power cord reception surface 80 of the cam 42 on the second bow limb 34.

Figure 4:
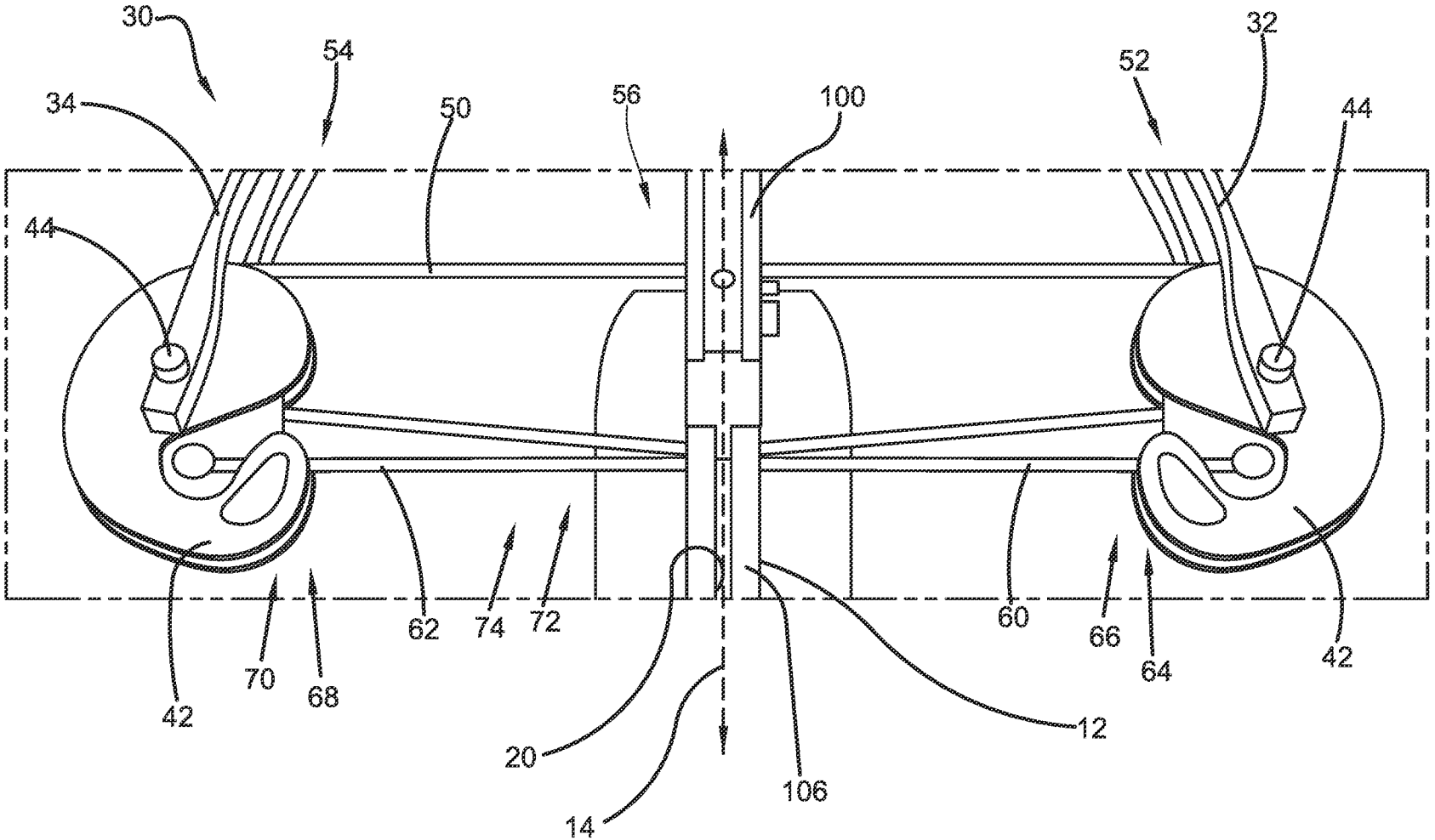
FIG. 4 is a top view showing a portion of a bow mechanism.
Figure 5:
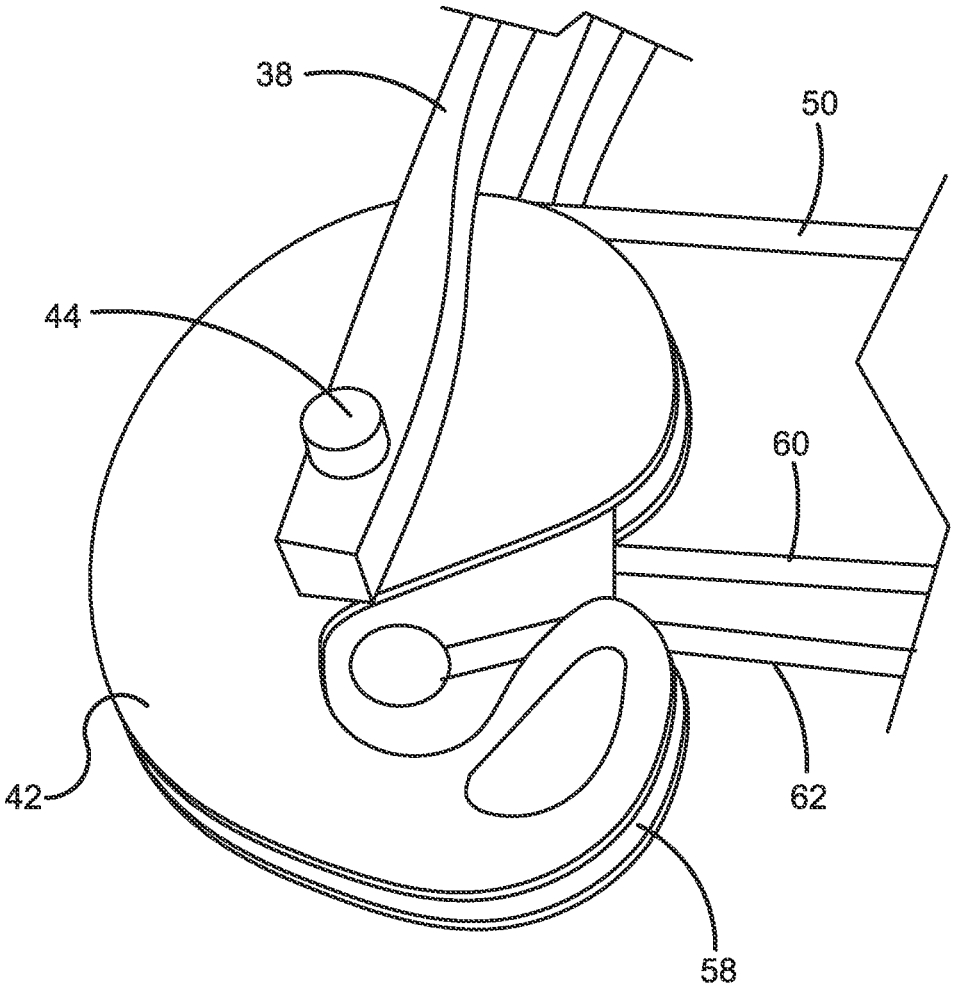
FIG. 5 is a top view of a cam.
Figure 6:
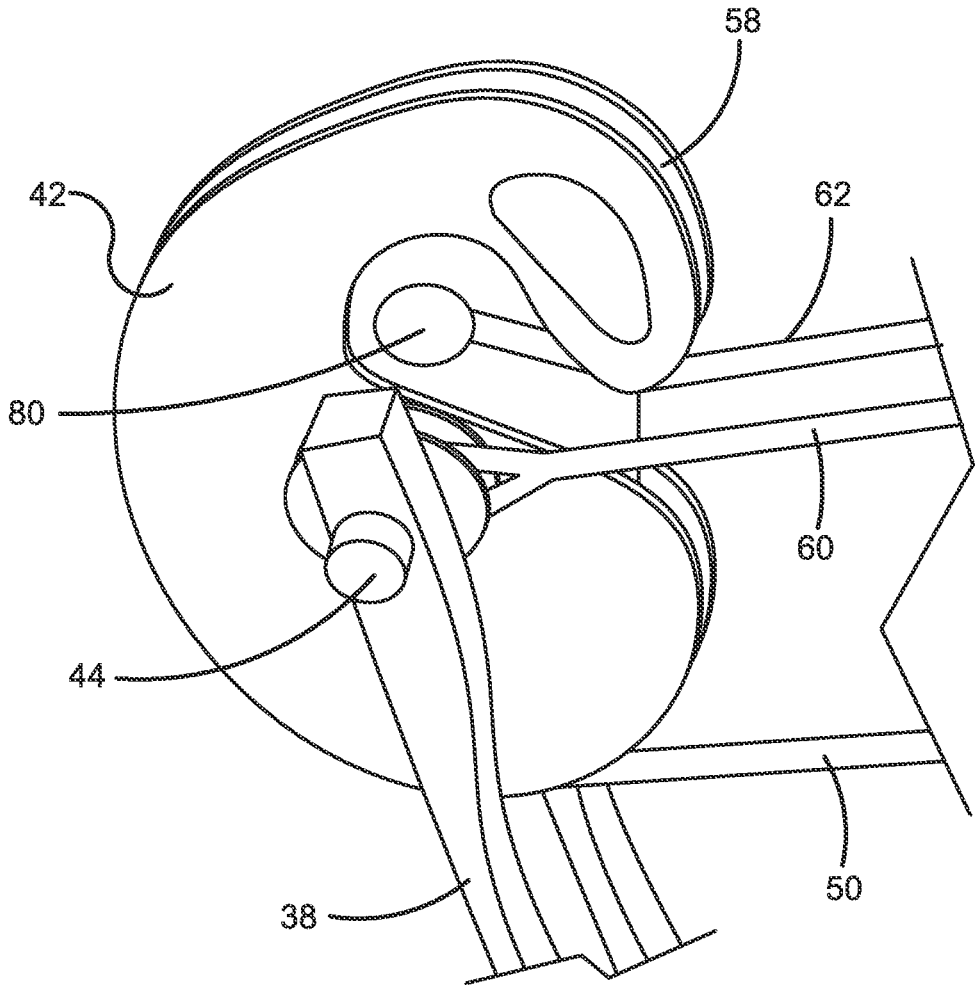
FIG. 6 is a bottom view of the cam shown in FIG. 5.
Figure 7:
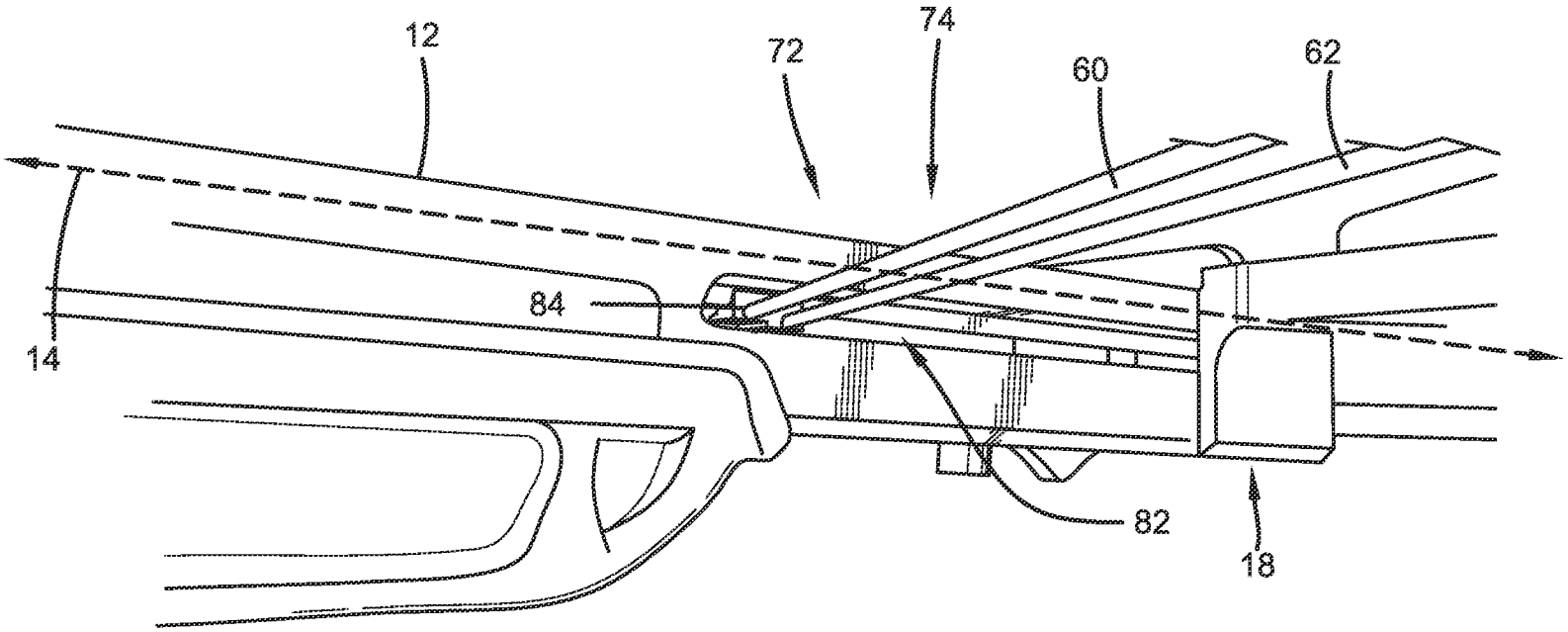
FIG. 7 is a perspective side view of a main beam.
Figure 8:
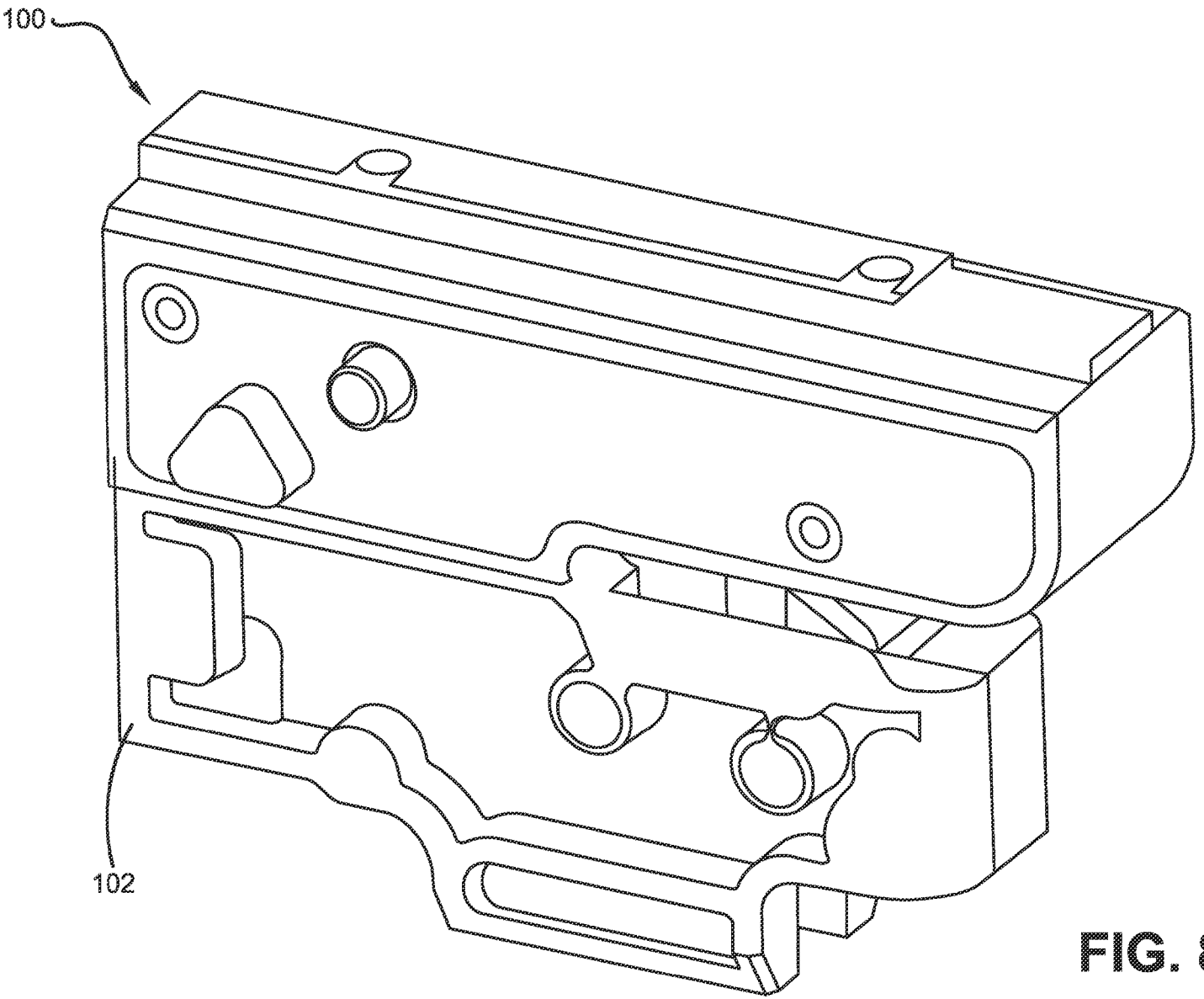
FIG. 8 is a perspective view of a traveling trigger mechanism.
Figure 9:
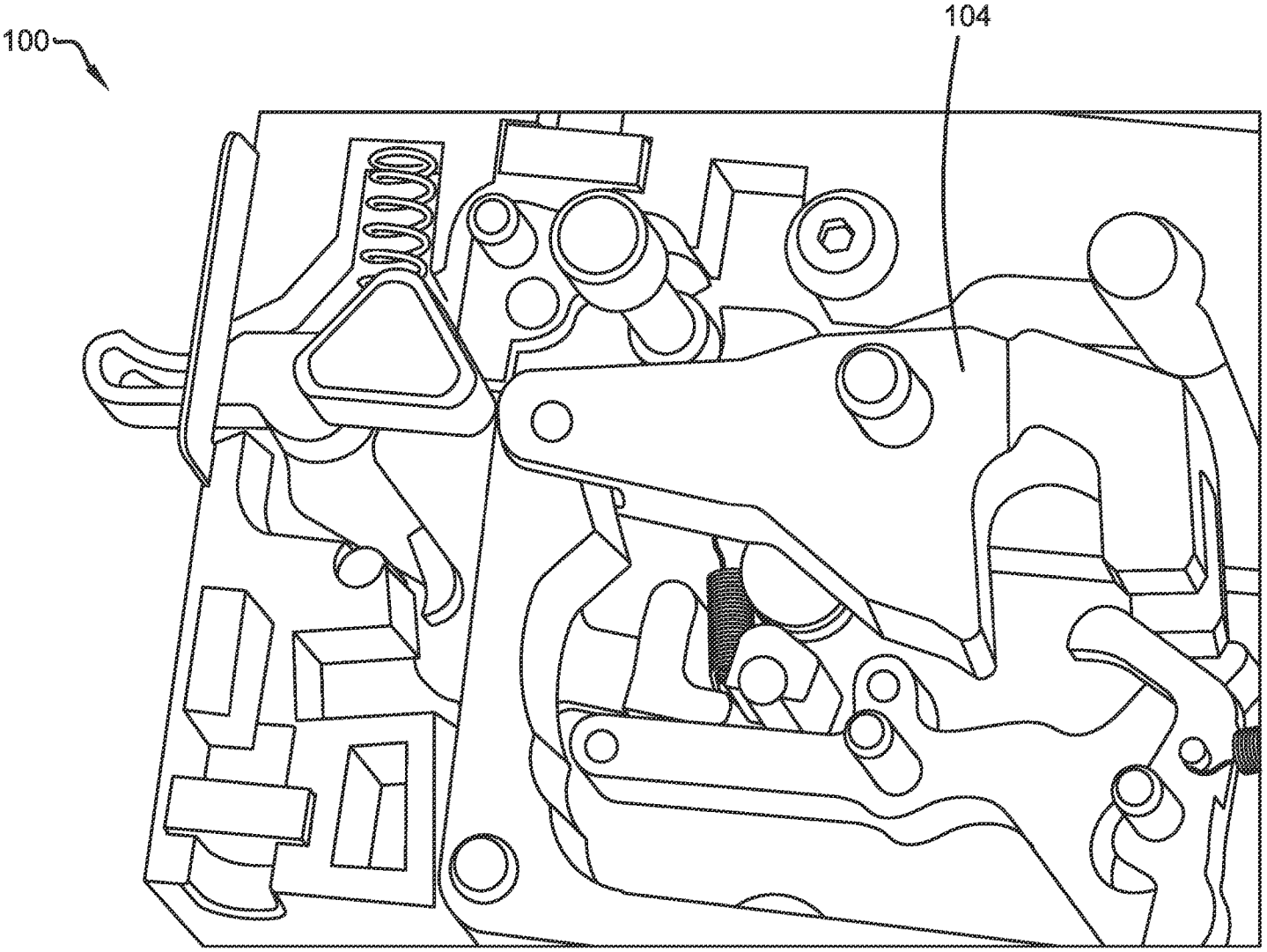
FIG. 9 shows a side view, with parts removed for clarity, of the traveling trigger mechanism shown in FIG. 8.
Figure 10:
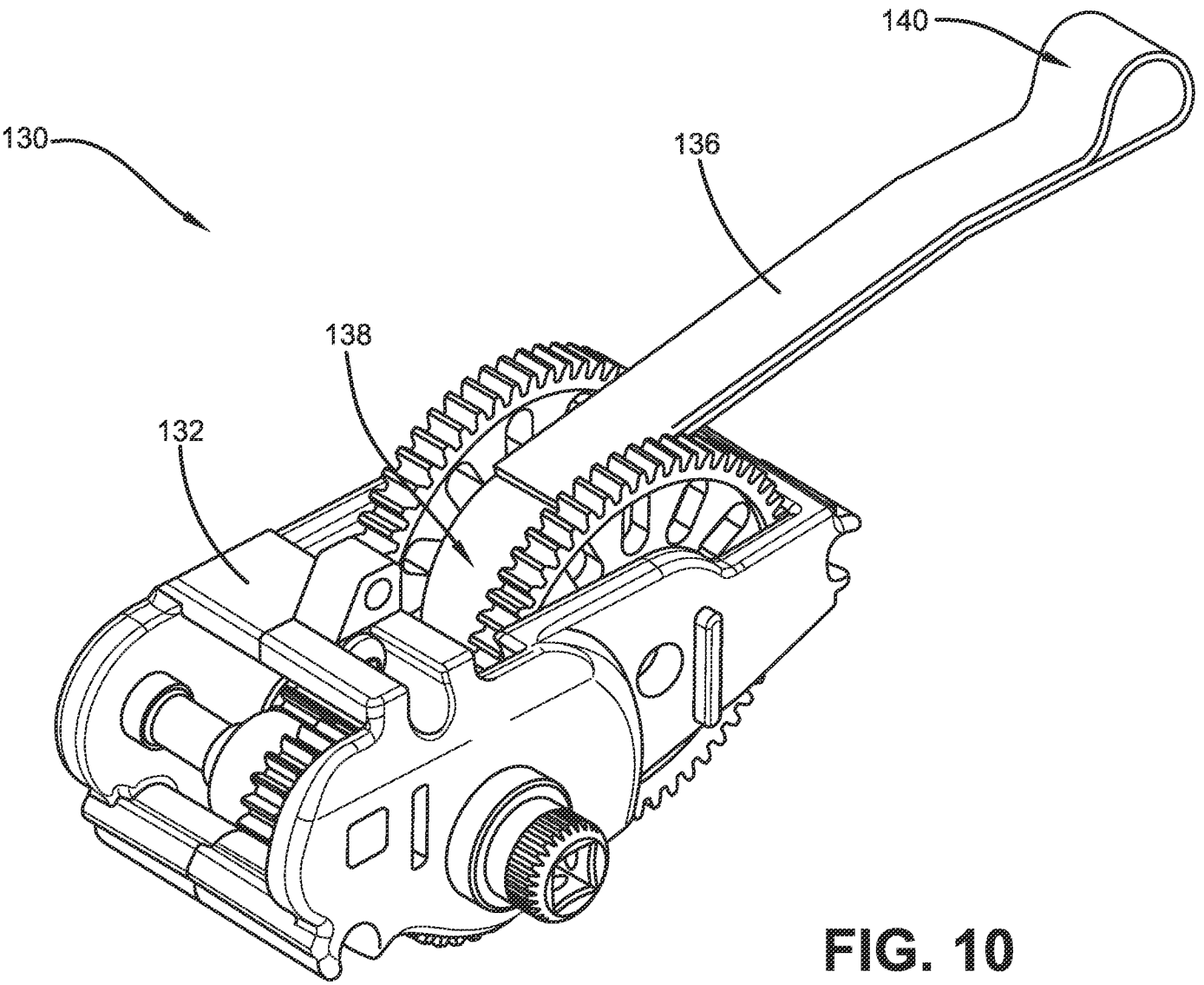
FIG. 10 is a perspective view of a drawing mechanism.
Figure 11:
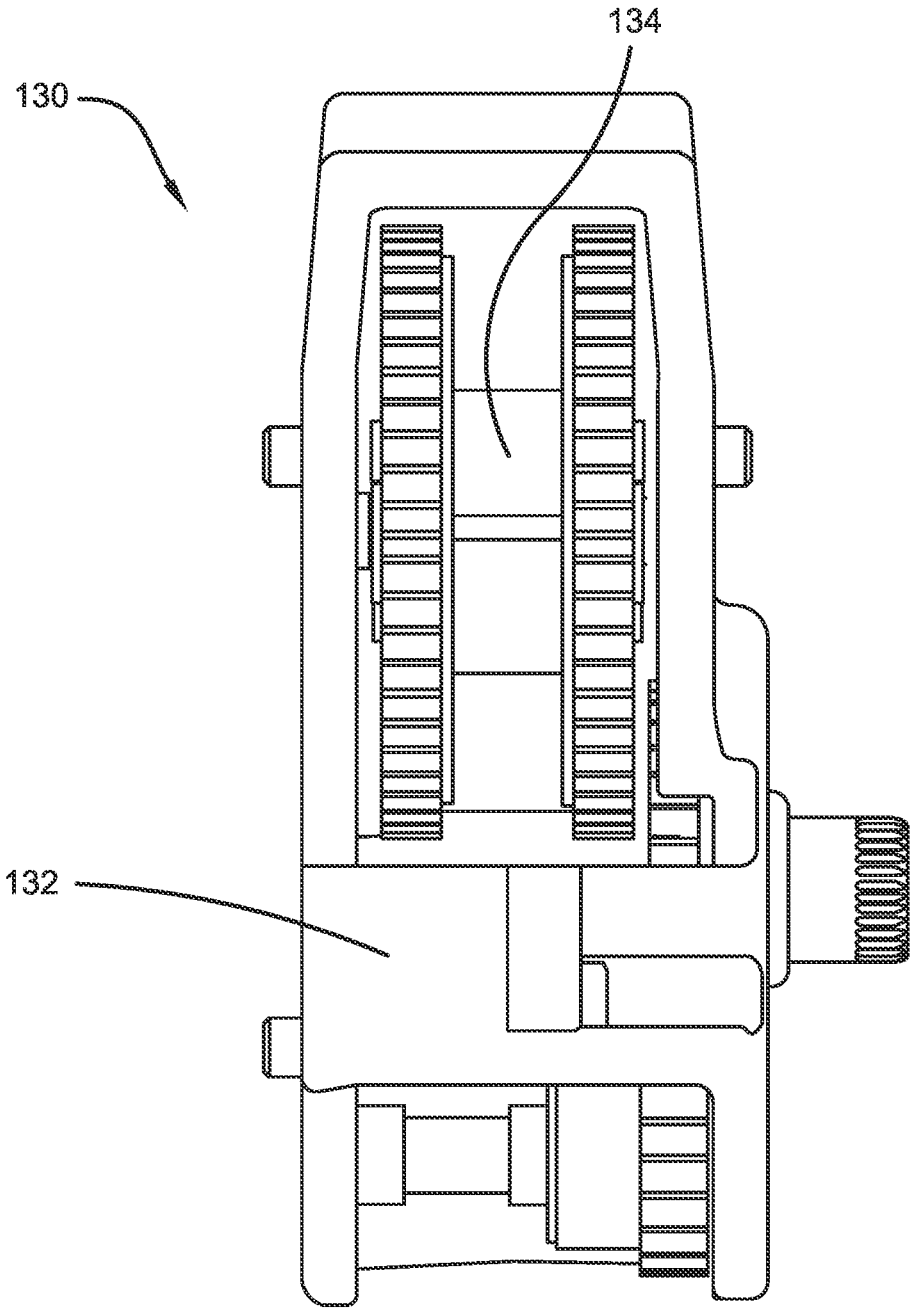
FIG. 11 is a top view, with parts removed for clarity, of the drawing mechanism shown in FIG. 10.

With reference now to FIGS. 1 and 4-7, the mid-sections 72, 74 of each power cord may extend across the longitudinal axis 14 from opposite lateral sides of the main beam 12 as shown, for example, in FIGS. 1, 4 and 7. To accommodate the power cord mid-sections 72, 74, as best seen in FIG. 7, the main beam 12 may have a power cord receiving opening 82 through which the mid-sections 72, 74 extend. In some embodiments, shown, a cable receiving device 84 is positioned at least partially within the power cord receiving opening 82. The cable receiving device 84 may receive the power cord mid-sections 72, 74 and may be selectively movable with respect to the main beam 12—especially when the crossbow 10 is cocked and fired. The cable receiving device 84 may be of any type chosen with the sound judgement of a person of skill in the art. Non-limiting examples of cable receiving devices that may be used with this invention include those disclosed in commonly owned: U.S. Pat. No. 9,200,863 titled CROSSBOW CABLE SAVER; U.S. Pat. No. 10,145,641 titled CROSSBOW PIVOTING CABLE SAVER; and U.S. Pat. No. 10,739,104 titled ROUTER SYSTEM, all of which are incorporated herein by reference in their entirety. For the embodiments shown, when the bowstring 50 is in the un-cocked position, the mid-section 56 of the bowstring 50 extends across the longitudinal axis 14 from opposite lateral sides of the main beam 12 and is positioned distally with respect to the mid-sections 72, 74 of the power cords 60, 62.

With reference now to FIGS. 1-4 and 8-9, bow mechanism 30 may include a traveling trigger mechanism chosen with sound judgment by a person of ordinary skill in the art. For the embodiments shown, traveling trigger mechanism 100 may include a trigger housing 102 and a string catch 104 supported to the trigger housing 102. The string catch 104 may be selectively movable between: a first string catch position that does not hold the bowstring 50 to the trigger housing 102 and a second string catch position that holds the bowstring 50 to the trigger housing 102. The main beam 12 may include a longitudinally extending track 106 along which and within which the traveling trigger mechanism 100 may be moved. When the bowstring 50 is in the un-cocked position, the traveling trigger mechanism 100 may be moved distally to the bowstring 50. The string catch 104 may then be moved from the first string catch position to the second string catch position, holding the bowstring 50 to the trigger housing 102. The traveling trigger mechanism 100 may then be moved proximally until the bowstring 50 is in the cocked position. Then, the string catch 104 may be moved into the first string catch position that does not hold the bowstring 50 and thus the crossbow fires. Further details concerning the operation of the traveling trigger mechanism 100 can be found in commonly owned U.S. application Ser. No. 17/314,801 all of which is incorporated herein by reference in its entirety.

With reference now to FIGS. 1-3 and 8-11, in some embodiments, the user may manually move the traveling trigger mechanism 100 proximally to cock the crossbow 10. Stirrup 90, which may be supported to the main beam 12, may be used in a known manner for this purpose. In other embodiments, bow mechanism 30 may include a drawing mechanism chosen with sound judgment by a person of ordinary skill in the art to move the traveling trigger mechanism 100 proximally to cock the crossbow and/or to move the traveling trigger mechanism 100 distally to de-cock the crossbow. For the embodiments shown, drawing mechanism 130 may include a drawing housing 132 supported to the main beam 12 and a spool 134 that is selectively rotatable with respect to the drawing housing 132. A tensile member 136 may have a first end 138 operatively engaged with the spool 134 and a second end 140 operatively engaged with the trigger housing 102. When the bowstring 50 is in the un-cocked position and the string catch 104 is in the second string catch position that holds the bowstring 50, the drawing mechanism 130 may be operable to move the traveling trigger mechanism 100 longitudinally, distally, along the main beam 12 to move the bowstring 50 from the un-cocked position to the cocked position. Further details concerning the operation of the drawing mechanism 130 can be found in commonly owned U.S. application Ser. No. 17/314,801 all of which is incorporated by reference in its entirety as noted above.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof. When the word "associated" is used in the claims, the intention is that the object so labeled is not positively claimed but rather describes an object with which the claimed object may be used.

Having thus described the invention, it is now claimed:

We claim:

1. A crossbow comprising:

a main beam:

1) extending longitudinally;

2) defining a longitudinal axis; and 3) having an arrow receiving surface for receiving an associated arrow;

a bow mechanism including:

1) first and second outwardly extending bow limbs extending transversely from opposite lateral sides of the main beam;

2) first and second bowstring wheels supported to the first and second bow limbs, respectively;

3) a bowstring operatively engaged to the first and second bowstring wheels and movable between:

(a) an un-cocked position; and (b) a cocked position; and 4) a first power cord having:
(a) a first end operatively engaged with at least one of the first bow limb and the first bowstring wheel;
(b) a second end, opposite the first end, operatively engaged with at least one of the second bow limb and the second bowstring wheel; and
(c) a mid-section between the first and second ends that extends across the longitudinal axis from opposite lateral sides of the main beam;

a traveling trigger mechanism including:
1) a trigger housing; and
2) a string catch supported to the trigger housing and selectively movable between:
(a) a first string catch position that does not hold the bowstring; and
(b) a second string catch position that holds the bowstring; and a drawing mechanism including:
1) a drawing housing supported to the main beam;
2) a spool that is selectively rotatable with respect to the drawing housing; and
3) a tensile member having:
(a) a first end operatively engaged with the spool; and
(b) a second end operatively engaged with the trigger housing;

wherein:
1) when the bowstring is in the un-cocked position and the string catch is in the second string catch position that holds the bowstring, the drawing mechanism is selectively operable to move the traveling trigger mechanism longitudinally along the main beam to move the bowstring from:
(a) the un-cocked position; to
(b) the cocked position; and
2) when the string catch is in the second string catch position that holds the bowstring and the bowstring is in the cocked position: the string catch is selectively movable into the first string catch position that does not hold the bowstring and fires the crossbow.

2. The crossbow of claim 1 wherein:
the main beam has a proximal end and a distal end;
the bow mechanism is supported to the distal end of the main beam; and
when the bowstring is in the un-cocked position:
1) the bowstring has a mid-section that extends across the longitudinal axis from opposite lateral sides of the main beam; and
2) the mid-section of the bowstring is positioned distally with respect to the mid-section of the first power cord.

3. The crossbow of claim 1 wherein:
the first bow limb has a first end supported to the main beam and a second end to which the first bowstring wheel is supported and the second end extends proximally with respect to the first end; and
the second bow limb has a first end supported to the main beam and a second end to which the second bowstring wheel is supported and the second end extends proximally with respect to the first end.

4. The crossbow of claim 1 wherein:
the first bowstring wheel is a cam:
1) that is pivotal about a pivot pin supported to the first bow limb;
2) having a bowstring reception surface that receives a first end of the bowstring; and
3) having a power cord reception surface;
the second bowstring wheel is a cam:
1) that is pivotal about a pivot pin supported to the second bow limb;
2) having a bowstring reception surface that receives a second end of the bowstring; and
3) having a power cord reception surface;
the first end of the first power cord is received on the power cord reception surface of the first wheel; and
the second end of the first power cord is received on the pivot pin of the second wheel.

5. The crossbow of claim 1 wherein:
the main beam has a longitudinally extending track; and
the drawing mechanism moves the traveling trigger mechanism along the track to move the bowstring from:
1) the un-cocked position; to
2) the cocked position.

6. The crossbow of claim 1 wherein:
the main beam has a power cord receiving opening; and
the mid-section of the first power cord extends through the power cork receiving opening.

7. The crossbow of claim 6 wherein:
a cable receiving device is positioned at least partially within the power cord receiving opening and is selectively movable with respect to the main beam; and
the mid-section of the first power cord is received in the cable receiving device.

8. The crossbow of claim 1 further comprises a second power cord distinct from the first power cord and having:
1) a first end operatively engaged with the at least one of the first bow limb and the first bowstring wheel;
2) a second end, opposite the first end, operatively engaged with the at least one of the second bow limb and the second bowstring wheel; and
3) a mid-section between the first and second ends that: extends across the longitudinal axis from opposite lateral sides of the main beam.

9. A crossbow method comprising the steps of:
A) providing a crossbow having:
1) a main beam:
(a) extending longitudinally;
(b) defining a longitudinal axis; and
(c) having an arrow receiving surface for receiving an associated arrow;
2) a bow mechanism including:
(a) first and second outwardly extending bow limbs extending transversely from opposite lateral sides of the main beam;
(b) first and second bowstring wheels supported to the first and second bow limbs, respectively;
(c) a bowstring operatively engaged to the first and second bowstring wheels; and
(d) a first power cord having:
(i) a first end operatively engaged with at least one of the first bow limb and the first bowstring wheel;
(ii) a second end, opposite the first end, operatively engaged with at least one of the second bow limb and the second bowstring wheel; and
(iii) a mid-section between the first and second ends that extends across the longitudinal axis from opposite lateral sides of the main beam;
B) providing a traveling trigger mechanism including:
1) a trigger housing; and
2) a string catch supported to the trigger housing;
C) providing a drawing mechanism including:
1) a drawing housing supported to the main beam;

2) a spool that is selectively rotatable with respect to the drawing housing; and
3) a tensile member having:
(a) a first end operatively engaged with the spool; and
(b) a second end operatively engaged with the trigger housing;

D) providing the bowstring to be movable between:
1) an un-cocked position; and
2) a cocked position;

E) providing the string catch to be selectively movable between:
1) a first string catch position that does not hold the bowstring; and
2) a second string catch position that holds the bowstring;

F) when the bowstring is in the un-cocked position and the string catch is in the second string catch position that holds the bowstring, providing the drawing mechanism to be selectively operable to move the traveling trigger mechanism longitudinally along the main beam to move the bowstring from:
1) the un-cocked position; to
2) the cocked position; and G) when the string catch is in the second string catch position that holds the bowstring and the bowstring is in the cocked position, providing the string catch to be selectively movable into the first string catch position that does not hold the bowstring and fires the crossbow.

10. The crossbow method of claim 9 wherein step A comprises the steps of:
providing the main beam with a power cord receiving opening; and
extending the mid-section of the first power cord through the power cord receiving opening.

11. The crossbow method of claim 10 further comprising the steps of:
positioning a cable receiving device at least partially within the power cord receiving opening;
positioning the mid-section of the first power cord into engagement with the cable receiving device; and
providing the cable receiving device to be selectively movable with respect to the main beam.

12. The crossbow method of claim 9 wherein:
step A comprises the step of: providing the main beam with a longitudinally extending track; and
step F comprises the step of: providing the drawing mechanism to be selectively operable to move the traveling trigger mechanism longitudinally along the track to move the bowstring from:
1) the un-cocked position; to
2) the cocked position.

13. The crossbow method of claim 9 wherein step A comprises the step of providing a second power cord distinct from the first power cord having:
1) a first end operatively engaged with the at least one of the first bow limb and the first bowstring wheel;
2) a second end, opposite the first end, operatively engaged with the at least one of the second bow limb and the second bowstring wheel; and
3) a mid-section between the first and second ends that: extends across the longitudinal axis from opposite lateral sides of the main beam.

14. The crossbow method of claim 9 wherein step A comprises the steps of:
providing the first bowstring wheel to be a cam:
1) that is pivotal about a pivot pin supported to the first bow limb;
2) having a bowstring reception surface that receives a first end of the bowstring; and
3) having a power cord reception surface;
providing the second bowstring wheel to be a cam:
1) that is pivotal about a pivot pin supported to the second bow limb;
2) having a bowstring reception surface that receives a second end of the bowstring; and
3) having a power cord reception surface;
attaching the first end of the first power cord to the power cord reception surface of the first wheel; and
attaching the second end of the first power cord to the pivot pin of the second wheel.

15. The crossbow method of claim 9 wherein step A comprises the steps of:
providing the main beam with a proximal end and a distal end;
supporting the bow mechanism to the distal end of the main beam;
providing the bowstring with a mid-section that extends across the longitudinal axis from opposite lateral sides of the main beam when the bowstring is in the un-cocked position;
positioning the mid-section of the bowstring distally with respect to the mid-section of the first power cord when the bowstring is in the un-cocked position;
supporting a first end of the first bow limb to the main beam;
supporting the first bowstring wheel to a second end of the first bow limb;
extending the second of the first bow limb proximally with respect to the first end of the first bow limb;
supporting a first end of the second bow limb to the main beam;
supporting the second bowstring wheel to a second end of the second bow limb; and
extending the second of the second bow limb proximally with respect to the first end of the second bow limb.

16. A crossbow comprising:
a main beam:
1) extending longitudinally;
2) defining a longitudinal axis;
3) having an arrow receiving surface for receiving an associated arrow; and
4) having a power cord receiving opening;
a cable receiving device that is positioned at least partially within the power cord receiving opening and is selectively movable with respect to the main beam;
a bow mechanism including:
1) first and second outwardly extending bow limbs extending transversely from opposite lateral sides of the main beam;
2) first and second bowstring wheels supported to the first and second bow limbs, respectively;
3) a bowstring operatively engaged to the first and second bowstring wheels and movable between:
(a) an un-cocked position; and
(b) a cocked position;
4) a first power cord having:
(a) a first end operatively engaged with at least one of the first bow limb and the first bowstring wheel;
(b) a second end, opposite the first end, operatively engaged with at least one of the second bow limb and the second bowstring wheel; and (c) a mid-section between the first and second ends that: extends across the longitudinal axis from opposite lateral sides of the main beam; is received in the cable receiving device; and extends through the power cord receiving opening; and 5) a second power cord distinct from the first power cord and having:

(a) a first end operatively engaged with the at least one of the first bow limb and the first bowstring wheel;

(b) a second end, opposite the first end, operatively engaged with the at least one of the second bow limb and the second bowstring wheel; and (c) a mid-section between the first and second ends that: extends across the longitudinal axis from opposite lateral sides of the main beam; is received in the cable receiving device; and extends through the power cord receiving opening;

a traveling trigger mechanism including:

1) a trigger housing; and 2) a string catch supported to the trigger housing and selectively movable between:

(a) a first string catch position that does not hold the bowstring; and (b) a second string catch position that holds the bowstring; and a drawing mechanism including:

1) a drawing housing supported to the main beam;

2) a spool that is selectively rotatable with respect to the drawing housing; and 3) a tensile member having:

(a) a first end operatively engaged with the spool; and (b) a second end operatively engaged with the trigger housing;

wherein:

1) when the bowstring is in the un-cocked position and the string catch is in the second string catch position that holds the bowstring: the drawing mechanism is selectively operable to move the traveling trigger mechanism longitudinally along the main beam to move the bowstring from:

(a) the un-cocked position; to (b) the cocked position; and 2) when the string catch is in the second string catch position that holds the bowstring and the bowstring is in the cocked position: the string catch is selectively movable into the first string catch position that does not hold the bowstring and fires the crossbow.

17. The crossbow of claim 16 wherein:

the main beam has a proximal end and a distal end;

the bow mechanism is supported to the distal end of the main beam; and when the bowstring is in the un-cocked position:

1) the bowstring has a mid-section that extends across the longitudinal axis from opposite lateral sides of the main beam; and 2) the mid-section of the bowstring is positioned distally with respect to the mid-sections of the first and second power cords.

18. The crossbow of claim 17 wherein:

the first bow limb has a first end supported to the main beam and a second to which the first bowstring wheel is supported and the second end extends proximally with respect to the first end; and the second bow limb has a first end supported to the main beam and a second to which the second bowstring wheel is supported and the second end extends proximally with respect to the first end.

19. The crossbow of claim 18 wherein:

the first bowstring wheel is a cam:

1) that is pivotal about a pivot pin supported to the first bow limb;

2) having a bowstring reception surface that receives a first end of the bowstring; and 3) having a power cord reception surface;

the second bowstring wheel is a cam:

1) that is pivotal about a pivot pin supported to the second bow limb;

2) having a bowstring reception surface that receives a second end of the bowstring; and 3) having a power cord reception surface;

the first end of the first power cord is received on the power cord reception surface of the first wheel;

the second end of the first power cord is received on the pivot pin of the second wheel;

the first end of the second power cord is received on the power cord reception surface of the second wheel; and the second end of the second power cord is received on the pivot pin of the first wheel.

20. The crossbow of claim 19 wherein:

the main beam has a longitudinally extending track; and the drawing mechanism moves the traveling trigger mechanism along the track to move the bowstring from:

1) the un-cocked position; to 2) the cocked position.

* * * * *